US005277340A

United States Patent [19]

Van Brocklin

[11] Patent Number: 5,277,340

[45] Date of Patent: Jan. 11, 1994

[54] DISPENSING CONTAINER

[75] Inventor: Owen F. Van Brocklin, Bristol, Conn.

[73] Assignee: Risdon Corporation, Naugatuck, Conn.

[21] Appl. No.: 972,164

[22] Filed: Nov. 5, 1992

[51] Int. Cl.[5] ..... B65D 88/54

[52] U.S. Cl. ..... 222/321; 222/385; 222/570; 285/921

[58] Field of Search ..... 222/321, 383, 385, 402.1, 222/570; 285/321, 921

[56] References Cited

U.S. PATENT DOCUMENTS

| | | | |
|---|---|---|---|
| 3,845,888 | 11/1974 | Focht | 285/921 X |
| 3,920,164 | 11/1975 | Lindsoe | 222/385 |
| 3,937,366 | 2/1976 | Steiman | 222/385 X |
| 4,610,468 | 9/1986 | Wood | 285/921 X |
| 5,102,018 | 4/1992 | Desazars de Montgailhard et al. . | |

FOREIGN PATENT DOCUMENTS

| | | |
|---|---|---|
| 2479152 | 10/1981 | France . |
| 2497178 | 7/1982 | France . |
| 2646408 | 11/1990 | France . |
| 0408421 | 1/1991 | France . |
| 2649382 | 1/1991 | France . |
| 2667050 | 3/1992 | France . |
| 2668118 | 4/1992 | France . |
| 2668119 | 4/1992 | France . |

*Primary Examiner*—Gregory L. Huson

*Attorney, Agent, or Firm*—St. Onge Steward Johnston & Reens

[57] ABSTRACT

A dispensing container for storing and dispensing liquid such as perfume, medicine and the like is disclosed. The dispensing container contains a reservoir for the liquid, a pump for dispensing the liquid and a sealing collar for sealing the pump with respect to the reservoir.

19 Claims, 2 Drawing Sheets

DISPENSING CONTAINER

The present invention relates to a dispensing container for storing and dispensing liquids, and more specifically, relates to the pump dispenser for storing and dispensing samples and other small volumes of liquid from a compact container.

BACKGROUND OF THE INVENTION

It is often desirable to dispense small quantities of liquid from a disposable container. For example, in the fragrance industry, it is desirable to provide sample products for testing of perfume by potential customers. In the fragrance industry, samples are often contained in vials that are broken open or plastic sealed packets that are torn open to dispense the perfume. It is widely recognized that in order for the potential customer to fully appreciate the perfume, the perfume should be dispensed in a mist, preferably through a pump dispenser of the type that is used on bottles of perfume. In order to produce a package suitable for samples for perfume, the package should be compact, inexpensive to produce, and relatively inexpensive so that it is disposable Further, it would be desirable to provide dispensing through an atomizing pump so that the consumer can ascertain the essence of the perfume when it is atomized during application.

One prior art sample pump dispenser is disclosed in U.S. Pat. No. 5,102,018 issued Apr. 7, 1992. This pump dispenser comprises a conventional pump that is sealed with respect to a container by a conventional compressed gasket seal. The seal is held in a place by a multi-part sealing mechanism. This design has several disadvantages including the cost and manufacturing problems associated with multiple parts to be manufactured and assembled, and an awkward external appearance due to the structure needed to accommodate the multiple parts.

It is an object of the present invention to provide a pump dispenser that has the advantages of being disposable, made from very few parts, and easily assembled. The further object of the invention is to provide a sample pump dispenser that provides an excellent liquid seal between the pump and the reservoir containing the liquid. It is a further object of the invention to provide a pump dispenser wherein the exterior appearance of the reservoir is simple and elegant, and has a clean, unbroken silhouette, which is important when a dispenser is used for consumer sampling of products such as fragrances, as well as in other industries wherein the appearance of the container is important.

SUMMARY OF THE INVENTION

In accordance with the present invention a dispensing container for storing and dispensing liquid such as perfume, medicine, and the like is disclosed. The dispensing container includes a reservoir for the liquid and the reservoir includes an opening at the top thereof and a tubular package between the opening and the reservoir. In a preferred form of the invention, the reservoir comprises a cylindrical tube having the opening at one end and which is closed at the other end.

A conventional dispenser is utilized such as a pump of the type described in U.S. Pat. No. 4,606,479 issued Aug. 19, 1986 and U.S. patent application No. 694,418 filed May 1, 1991, or other conventional pump assemblies for dispensing liquid.

In order to provide a seal between the pump assembly and the reservoir, the sealing collar is provided. The collar comprises a resilient deformable polymeric material which provides a seal between the collar and the reservoir. The sealing collar has a frustoconical outer wall separated from a main body of the sealing collar. The top of the outer wall has a diameter which is greater than the diameter of the bottom of the wall to provide a taper angle of the frustoconical outer wall. The outer wall is deformable to permit the wall to flex radially inwardly.

The tubular passage of the reservoir has an interior wall that has a recess sized to receive the outer wall of the collar. The recess has a floor for retaining the bottom of the outer wall of the collar against vertical downward movement, and at a ledge for retaining the top of the outer wall of the collar against vertical upward movement.

The tubular passage has a diameter at the upper ledge of the recess that is smaller than the diameter of the top of the sealing collar. After liquid such as perfume or other dispensable liquid is placed in the reservoir, the sealing collar and pump assembly are inserted through the opening from above. During insertion, the outer wall of the sealing collar flexes radially inwardly as it passes the ledge. Once the top of the frustoconical wall passes the ledge it snaps radially outwardly into contact with the sidewall of the recess to form a liquid seal between the outer wall and the sidewall of the recess.

In accordance with one aspect of the invention, the dispensing container consists of only two subassemblies: (1) the reservoir and (2) the sealing collar and the pump assembly. Preferably, the reservoir consists of a polymeric material which is formed in a single integral part. Also, preferably, the sealing collar consists of a polymeric material which is formed in a single integral part. The pump is drawn from a variety of conventionally manufactured pump assemblies that are readily available. Thus, a dispensing pump and container in accordance with this aspect of the invention has a unique advantage of utilizing only two subassemblies to provide a dispensing pump and container which is easily manufactured and assembled. Further, the unique manner in which the sealing collar engages and seals with the tubular passage of the reservoir provides for an aesthetically pleasing external appearance wherein the dispenser has a clean, uncluttered silhouette.

In accordance with another aspect of the invention, the conventional pump assembly has a cylindrical actuator button from which liquid is dispensed. The button has a top surface for application of finger pressure. The actuator button has a diameter that is slightly less than the diameter than the opening of the reservoir. Thus, the actuator button is movable between a rest position downwardly through a pump stroke wherein the actuator button moves within the tubular package of the reservoir. This provides the advantage that the pump mechanism and the sealing collar is located internal of the actuator button and the reservoir. Thus, only the actuator button and the outer surface of the reservoir are visible by a person using the dispenser.

Other advantages of a dispensing container in accordance with the present invention will be apparent from the detailed description of the invention which follows.

DETAILED DESCRIPTION OF THE INVENTION

Figure 1:
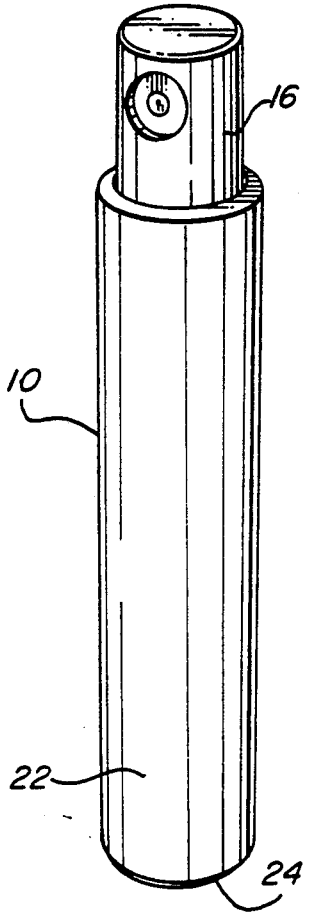
FIG. 1 is a perspective view of the dispensing pump and container in accordance with the present invention.
Figure 2:
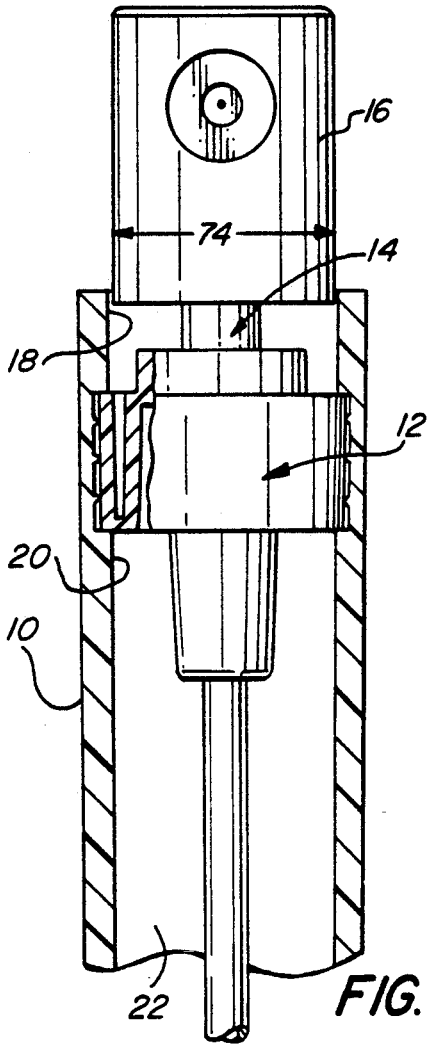
FIG. 2 is a partial sectional view through the reservoir shown in FIG. 1 and through a sealing collar shown in FIGS. 3 and 4.

Referring to FIGS. 1 and 2, a dispensing pump and container in accordance with the present invention is shown. The dispensing pump includes a reservoir 10, a sealing collar 12, and a conventional pump assembly 14 having an actuator button 16.

Referring to FIGS. 1, 2, 5 and 6, the reservoir 10 includes an opening 18 for receiving the sealing collar 12 and the pump assembly 14. A tubular passage 20 extends between the opening 18 and the reservoir 22 which contains the liquid to be dispensed. In accordance with a preferred aspect of the invention, the reservoir comprises a cylinder that includes opening 18 at the top thereof and a bottom 24 that closes the reservoir. The exterior surface of reservoir 10 preferably comprises a smooth unbroken finish which provides an aesthetically pleasing dispensing container.

Figure 3:
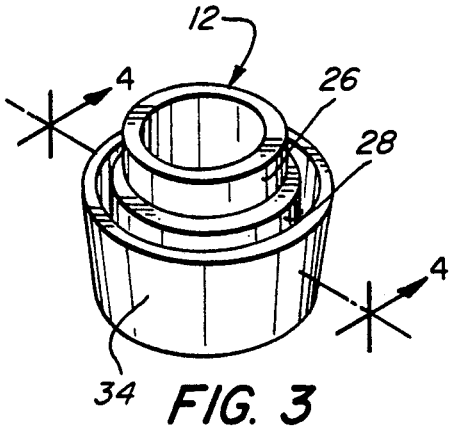
FIG. 3 is a perspective view of the sealing collar shown in FIG. 2.
Figure 4:
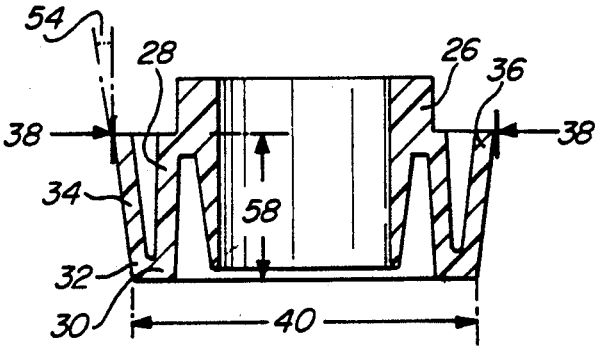
FIG. 4 is a sectional view of the sealing collar along the lines 4—4 of FIG. 3.

Referring in particular to FIGS. 3 and 4, the sealing collar includes a main body 26 having a generally cylindrical peripheral wall 28. Peripheral wall 28 has a bottom 30 that is attached to the bottom 32 of outer wall 34. The outer wall is frustoconical in shape. The outer wall has a top 36 that has a diameter 38 which is greater than the diameter 40 of the bottom 32 of the outer wall 34 to provide the desired frustoconical taper. The outer wall 34 preferably has a predetermined thickness that is deformable to permit the wall 34 to flex radially inwardly.

In accordance with a preferred aspect of the invention, the sealing collar is formed from a flexible polymeric material in a single integral part. More preferably, the part is molded from polyethylene.

As shown in FIG. 2, the pump assembly 14 is secured to the sealing collar 12 in a conventional fashion. The pump can be secured to the sealing collar in a number of different fashions, one of which is disclosed in U.S. Pat. No. 5,108,013 issued Apr. 28, 1992 which is incorporated by reference herein. The sealing collar 12 and pump assembly 14 are assembled and inserted through opening 18 in the reservoir to secure the pump assembly 14 in place and to seal the pump assembly with respect to the tubular passage of the reservoir.

Figure 5:
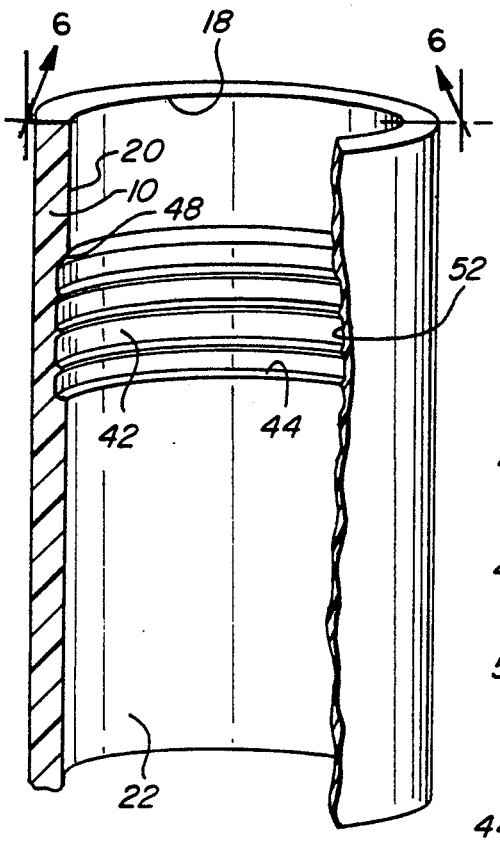
FIG. 5 is a perspective partial sectional view of the inside of the reservoir with the recess shown in detail; and, FIG. 6 is an expanded sectional view along the lines 6—6 of FIG. 5.
Figure 6:
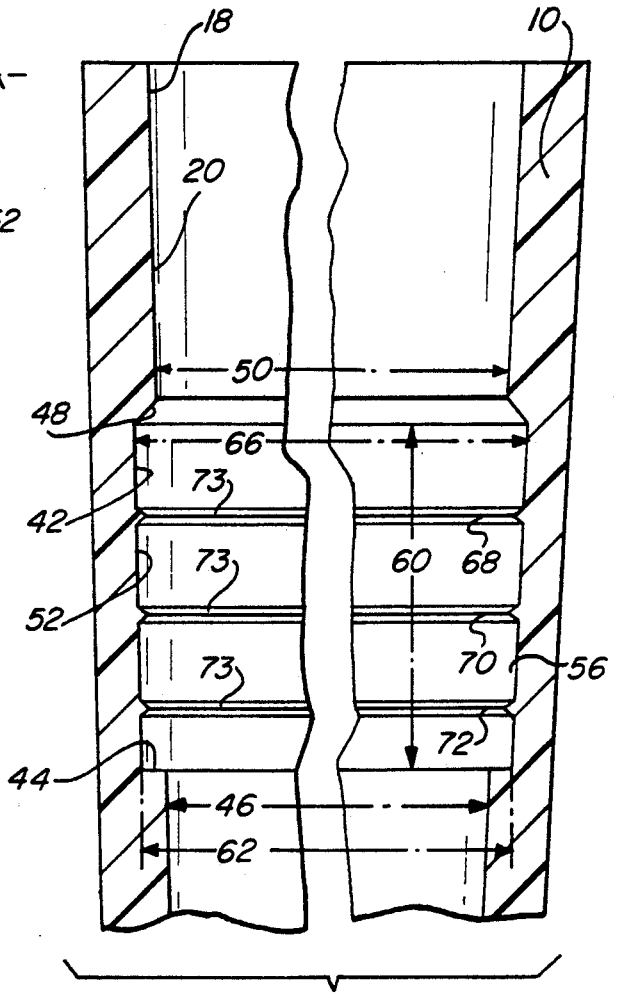

Referring to FIGS. 5 and 6, recess 42 for receiving the frustoconical outer wall 34 of the sealing collar 12 will now be described. Recess 42 has a floor 44 for retaining the bottom 32 of the sealing collar 12 against vertical downward movement. More specifically, the diameter 46 of the tubular passage 20 is less than the diameter 62 of the recess 42, and is also less than the outer diameter 40 of the sealing collar 12. Thus, when the sealing collar 12 is inserted into the tubular passage 20, it comes to rest against floor 44, and can proceed no further into the tubular passage 20.

The recess 42 also has a ledge 48 for retaining the top 36 of the outer wall 34 against vertical upward movement. The diameter 50 of the tubular passage just above the ledge 48 is less than the diameter 66 of the recess 42, and is also less than the diameter 38 of the top 36 of the sealing collar 12. When the sealing collar 12 is inserted into the tubular passage 20, the collar outer wall 34 flexes radially inwardly as it passes the ledge 48 and then moves radially outwardly once it has passed the ledge 48 to position the outer wall 34 adjacent the circumferential sidewall 52 of the recess. The outer wall 34 of the sealing collar 12 forms liquid seal with the circumferential sidewall 52 to retain liquid in the reservoir 10.

In accordance with one aspect of the invention, the outer wall 34 of the sealing collar 12 is frustoconical and has a taper angle 54 of between about 5 to about 10 degrees with respect to vertical. The circumferential sidewall 52 of the recess also has a taper angle 56 with respect to vertical, such taper angle being in the range between about 0.5 and about 3 degrees. The taper angle 54 of the sealing collar should be greater than a taper angle 56 of the recess sidewall Thus, when the sealing collar 12 is seated in the recess 42, the pressure between the sidewall 52 and the outer wall 34 increases along the height of the outer wall 34 from the bottom 30 to the top 36.

In addition, the outer wall 34 of the sealing collar 12 has a height 58 that is slightly less than the height 60 of the recess 42 to permit a snug fit of the outer wall 34 into the recess 42.

The floor 44 of the recess 42 has a diameter 62 which is preferably greater than the diameter 40 of the bottom 30 the sealing collar 12. Thus, when the sealing collar 12 is positioned on floor 44, there is a close fit between the sidewall 52 and the outer wall 32 at the bottom thereof. The top diameter 66 of the recess 42 at the ledge 48 is smaller than the top diameter 38 of the sealing collar 12 to provide an interference fit and an annular area of contact as best illustrated in FIG. 2.

In accordance with another aspect of the invention, the circumferential sidewall 52 of the recess 42 has a plurality of spaced apart ridges 68, 70 and 72. Each ridge includes a sharpened edge 73 that cuts into the outer wall 34 of the sealing collar 12. Because the sealing collar outer 34 wall has a greater taper angle than the taper angle of the circumferential sidewall 52 of the recess 42, the pressure of the outer wall 34 against ridge 68 is greater than the pressure of the outer wall 34 against ridge 70. Thus, ridge 68 digs further into the surface of the outer wall 34 than ridge 70. Likewise, ridge 70 digs further into the outer wall 34 than does ridge 72. The deformation of the outer wall 34 of the sealing collar by the ridges 68, 70, 72 provides a liquid seal that extends around the circumference of the ridges. In particular, a first seal is provided by ridge 72, a second seal is provided by ridge 70, and a third seal is provided by ridge 68. The triple seal is effective to minimize any leakage of liquid from the reservoir 10.

In accordance with one aspect of the invention, the dispensing container has two subassemblies for ease of manufacture and for reduction in costs of parts. More specifically, the first subassembly is the reservoir 10, the second subassembly is the sealing collar 12 and the pump assembly 14.

The pump assembly 14 with the sealing collar 12 is assembled with the actuator 16 in advance. The reservoir 10 is then separately filled, and the sealing collar 12 is fitted into the reservoir 10 until the outer wall 34 is snap fitted into the recess 42 in reservoir 10.

In accordance with one aspect of the invention, the actuator button 16 has a generally cylindrical shape and has a diameter 74 that is slightly less than the diameter of opening 18. Thus, as shown in FIG. 1, once the dispensing pump and container are assembled, one only sees two parts: the reservoir and the actuator button. The actuator button is movable between a rest position downwardly through a pump stroke wherein the actuator button moves internal to the reservoir. Thus, a very simple outward appearance is provided without an aesthetically detracting pump/reservoir fastener or other break line that is visible to the user.

It should be understood that although specific embodiments of the invention have been described herein in detail, such description is for purposes of illustration only and modifications may be made thereto by those skilled in the art within the scope of the invention.

I claim:

1. A dispensing container for storing and dispensing liquid comprising:

a reservoir for receiving said liquid, said reservoir including an opening for receiving a liquid dispenser and, a passage between the opening and the reservoir;

a sealing collar for sealing the dispenser with respect to the tubular passage, said sealing collar having a frustoconical outer wall, said outer wall having a top having a diameter and a bottom having a diameter that is smaller than said top diameter, said outer wall being deformable to permit the wall to flex radially inwardly, said passage having an interior wall having a recess sized to receive said outer wall of the collar, said recess having a floor for retaining the bottom of said collar outer wall against vertical downward movement and a ledge for retaining the top of the outer wall against vertical upward movement, said recess having a circumferential sidewall bounded by said recess floor and said recess ledge, said tubular passage having a diameter at the upper ledge of said recess that is smaller than the top diameter of the sealing collar outer wall, said sealing collar being insertable into such reservoir with said outer wall of said sealing collar flexing radially inwardly as it passes the ledge and moving radially outwardly once the outer wall has passed the ledge to seat against and form a liquid seal with said circumferential sidewall.

2. A dispensing container according to claim 1 wherein said circumferential sidewall of said recess has a frustoconical shape.

3. A dispensing container according to claim 2 wherein said outer wall of said sealing collar includes a height and said recess sidewall includes a height, said outer wall height being slightly less than the height of said recess sidewall.

4. A dispensing container according to claim 3 wherein said frustoconical outer wall of said sealing collar has a taper angle with respect to vertical and said frustoconical recess sidewall has a taper angle with respect to vertical, and wherein said taper angle of said outer wall is greater than the taper angle of said recess sidewall to provide pressure between the sidewall and the outer wall, said pressure increasing along the height of the outer wall.

5. A dispensing container according to claim 4 wherein the circumferential sidewall at the floor of the recess has a diameter that is slightly greater than the diameter of the bottom of the outer wall of the sealing collar to provide a non-interference fit between the bottom of the outer wall of the sealing collar and the recess sidewall, and the diameter of the top of the outer wall of said sealing collar being larger than the diameter of circumferential sidewall of the recess at the ledge to provide an interference fit, said outer wall of said sealing collar contacting the sidewall of said recess to provide an annular area of contact.

6. A dispensing container according to claim 5 and further including at least one annular ridge extending from the surface of at least one of said frustoconical walls, said annular ridge being seated against the surface of the other of said walls by said pressure between the sidewall and the outer wall.

7. A dispensing container according to claim 6 and further including at least three spaced apart annular ridges extending from said one wall, said annular ridges contacting said other wall.

8. A dispensing container according to claim 7 wherein said plurality of ridges include sharpened edges that cut into said other wall.

9. A dispensing container according to claim 8 wherein the ridges cut into said outer wall to a depth, said depth of cut increasing as each said ridge is located closer to the top of the outer wall sealing collar.

10. A dispensing container according to claim 9 wherein said ridges extend radially inwardly from said sidewall of said recess.

11. A dispensing container according to claim 10 wherein said liquid dispenser comprises a pump for dispensing liquid from said reservoir, said pump being sealed with respect to said sealing collar.

12. A dispensing container according to claim 11 wherein said pump includes a cylindrical actuator button having an outer diameter, said outer diameter of said actuator button being slightly less than the inner diameter of said opening to permit insertion of the actuator button into the opening.

13. A dispensing container according to claim 12 wherein said reservoir and said tubular passage consist essentially of a cylindrical tube having said opening at the top thereof and a closed bottom.

14. A dispensing pump and container comprising first and second subassemblies;

said first subassembly comprising a reservoir for receiving said liquid, said reservoir including an opening, said reservoir including a tubular passage between the opening and the reservoir, said reservoir consisting of a polymeric material and being formed in a single integral part;

said second subassembly comprising a pump mechanism for pumping liquid from said reservoir; a cylindrical actuator button; and a sealing collar for sealing the pump mechanism with respect to the tubular passage of said reservoir, said sealing collar comprising a resilient deformable polymeric material, said sealing collar being force fitted into said tubular passage of said reservoir to provide a liquid seal between said sealing collar and said tubular passage, said actuator button having a diameter, and said opening of said reservoir including a diameter, said actuator button diameter being slightly less than the said diameter of the opening to permit said actuator button to be inserted into the opening, said actuator button being movable between a rest position downwardly through a pump stroke, said sealing collar and said pump mechanism being located completely internal of said actuator button and said reservoir wherein only the actuator button and the reservoir are visible external to said dispensing container.

15. A dispensing pump and container according to claim 14 wherein said sealing collar has a frustoconical outer wall, said outer wall having a top having a diameter and a bottom having a diameter that is smaller than said top diameter to provide a taper, said outer wall being deformable to permit the wall to flex radially inwardly, said tubular passage having a recess sized to receive said outer wall of the collar, said recess having a floor for retaining the bottom of said collar outer wall against vertical downward movement and a ledge for retaining the top of the outer wall against vertical upward movement, said recess having a circumferential sidewall bounded by said recess floor and said recess ledge, said tubular passage having a diameter at the upper ledge of said recess that is smaller than the top diameter of the sealing collar outer wall, said collar being insertable into such reservoir with outer wall flexing radially inwardly as it passes the ledge and moving radially outwardly once the outer wall has passed the ledge to form a liquid seal between the outer wall and adjacent the circumferential sidewall of said recess.

16. A dispensing pump and container according to claim 15 wherein said sealing collar has a main body and wherein the bottom of the outer wall is attached to said main body and the remainder of the outer wall is separated from said main body to permit the outer wall to flex radially inwardly with respect to the main body of the sealing collar.

17. A dispensing pump and container according to claim 16 wherein said main body includes a cylindrical peripheral wall having a bottom, said outer wall having a predetermined thickness and being angled with respect to said cylindrical peripheral wall, said outer wall angling radially inwardly from top to bottom, said peripheral wall of said main body having a bottom which is joined with the bottom of the outer wall.

18. A dispensing pump and container comprising first and second subassemblies;

said first subassembly comprising a reservoir for receiving said liquid, said reservoir including an opening, said reservoir including a tubular passage between the opening and the reservoir, said reservoir being formed in a single integral part, said reservoir having an exterior surface having the shape of a cylinder, said surface being smooth and unbroken;

said second subassembly comprising a pump mechanism for pumping liquid from said reservoir; a cylindrical actuator button; and a seal for sealing the pump mechanism with respect to the tubular passage of said reservoir, said second subassembly being inserted from above into said tubular passage of said reservoir to provide a liquid seal between said seal and said tubular passage, said actuator button having a diameter, and said opening of said reservoir including a diameter, said actuator button diameter being slightly less than the said diameter of the opening to permit said actuator button to be inserted into the opening, said actuator button being movable between a rest position downwardly through a pump stroke, said seal and said pump mechanism being located completely internal of said actuator button and said reservoir wherein only the actuator button and the reservoir are visible external to said dispensing container.

19. A dispensing pump and container comprising:

said first subassembly comprising a reservoir for receiving said liquid, said reservoir including an opening, said reservoir including a tubular passage between the opening and the reservoir, said reservoir having an exterior surface that is smooth and unbroken, said reservoir comprising a polymeric material and being formed in a single integral part;

said second subassembly comprising a pump mechanism for pumping liquid from said reservoir; a cylindrical actuator button; and means for sealing the pump mechanism with respect to the tubular passage of said reservoir, said second subassembly being inserted from above into said tubular passage of said reservoir to provide a liquid seal between said sealing collar and said tubular passage, said actuator button having a diameter, and said opening of said reservoir including a diameter, said actuator button diameter being slightly less than the said diameter of the opening to permit said actuator button to be inserted into the opening, said actuator button being movable between a rest position downwardly through a pump stroke, said sealing collar and said pump mechanism being located completely internal of said actuator button and said reservoir wherein only the actuator button and the reservoir are visible external to said dispensing container.

* * * * *